US008430252B2

(12) United States Patent
Susan

(10) Patent No.: US 8,430,252 B2
(45) Date of Patent: Apr. 30, 2013

(54) WALL MOUNTED SHELVING SYSTEM

(76) Inventor: Edward T. Susan, Elon College, NC (US)

( * ) Notice: Subject to any disclaimer, the term of this patent is extended or adjusted under 35 U.S.C. 154(b) by 182 days.

(21) Appl. No.: 12/839,625

(22) Filed: Jul. 20, 2010

(65) Prior Publication Data

US 2012/0018396 A1 Jan. 26, 2012

(51) Int. Cl.
*A47F 5/08* (2006.01)
*A47B 5/00* (2006.01)
*A47G 29/02* (2006.01)

(52) U.S. Cl.
USPC ..... 211/90.01; 108/152; 248/250

(58) Field of Classification Search ..... 211/90.01, 211/18, 32, 35, 63, 87.01, 88.01, 90.02, 90.04, 211/103, 186, 187, 190, 207; 248/223.41, 248/225.21, 235, 243, 250; 108/152, 42; 312/245
See application file for complete search history.

(56) References Cited

U.S. PATENT DOCUMENTS 2,708,147 A * 5/1955 Burke et al. ..... 312/111
3,042,978 A * 7/1962 Eames et al. ..... 52/32
3,265,344 A * 8/1966 Ornstein ..... 248/243
3,603,274 A * 9/1971 Ferdinand et al. ..... 108/108
3,634,983 A * 1/1972 Welch ..... 52/27.5
3,672,624 A * 6/1972 Keller ..... 248/243
3,704,675 A * 12/1972 Bellasalma ..... 108/152
3,707,273 A * 12/1972 Bortz ..... 248/235
3,754,518 A * 8/1973 Wachtel ..... 108/152
4,008,872 A * 2/1977 Thompson ..... 248/224.61
4,121,801 A * 10/1978 Kellogg ..... 248/235
4,133,507 A * 1/1979 Chervenak ..... 248/223.41
4,165,852 A * 8/1979 Chervenak ..... 248/223.41
4,198,913 A * 4/1980 Haworth et al. ..... 108/108
4,299,367 A * 11/1981 Harlan ..... 248/235
4,342,397 A * 8/1982 Halstrick ..... 211/191
4,428,172 A * 1/1984 Larsson ..... 52/489.1
4,793,267 A * 12/1988 Birillo ..... 108/152
4,899,971 A * 2/1990 Elkin ..... 248/225.11
5,050,832 A * 9/1991 Lee et al. ..... 248/225.11
5,135,194 A * 8/1992 Laughon et al. ..... 248/243
5,197,703 A * 3/1993 Pratolongo ..... 248/225.11
5,205,524 A * 4/1993 Cohen ..... 248/235
5,222,611 A * 6/1993 Wood et al. ..... 211/94.01
5,718,493 A * 2/1998 Nikolai ..... 312/245
5,960,965 A * 10/1999 Saunders ..... 211/35
5,964,438 A * 10/1999 Camilleri ..... 248/225.21
6,164,462 A * 12/2000 Mumford ..... 211/59.2
6,345,579 B1 * 2/2002 Zaturensky ..... 108/152
6,615,745 B2 * 9/2003 Cinkaj ..... 108/152
2006/0091271 A1 * 5/2006 Nowak ..... 248/225.21

* cited by examiner

*Primary Examiner* — Jonathan Liu
*Assistant Examiner* — Joshua Rodden
(74) *Attorney, Agent, or Firm* — Olive Law Group, PLLC

(57) ABSTRACT

A wall mounted shelving system is provided. The system includes a support rail mountable on a wall and having a notch on a wall-facing surface thereof. At least one support member is mountable on the rail and defines an end portion for abutting the wall and further defines a recess having a rail receiving portion and a bracket receiving portion. The bracket receiving portion includes a slot with a notch formed at an end thereof. A bracket is configured to extend from the rail through the slot of the bracket receiving portion and has a first flange on a first end thereof for engaging the notch of the bracket receiving portion and a second flange on a second end thereof for engaging the notch of the support rail.

9 Claims, 6 Drawing Sheets

WALL MOUNTED SHELVING SYSTEM

TECHNICAL FIELD

This application is directed towards a shelving system, and more particularly towards a wall mounted shelving system that is easily assembled, has increased load bearing characteristics, and is aesthetically pleasing.

BACKGROUND

Many homes have a shelving system installed within closets for providing efficient storage and ease of access for clothing and other personal goods. However, conventional shelving systems suffer from a variety of disadvantages including relatively difficult installation and limitations on the weight bearing capacity of those shelving systems. Furthermore, conventional shelving systems may also suffer from being too complex in design and having an undesirable number of parts or an inability to be adapted for closets and homes of varying sizes. In addition, conventional shelving systems may be expensive to manufacture or may be aesthetically unpleasing to the consumer. Various shelving systems have been designed to address one or more of these disadvantages, however, none of these designs have addressed all of these disadvantages.

Accordingly, a need exists for a shelving system that addresses the aforementioned disadvantages associated with the prior art.

SUMMARY

According to one aspect of the disclosed subject matter, a wall mounted shelving system is provided. The system includes a support rail mountable on a wall and having a notch on a wall-facing surface thereof. The at least one support member is mountable on the rail and defines an end portion for abutting the wall and further defines a recess having a rail receiving portion and a bracket receiving portion. The bracket receiving portion includes a slot with a notch formed at an end thereof. A bracket is configured to extend from the rail through the slot of the bracket receiving portion and has a first flange on a first end thereof for engaging the notch of the bracket receiving portion and a second flange on a second end thereof for engaging the notch of the support rail.

According to another aspect, a support-facing surface of the rail engages a wall-facing surface of the rail receiving portion.

According to another aspect, the support member is moveable from a first position in which the second flange of the bracket is not in engagement with the notch of the support rail and a second position in which the second flange of the bracket is in engagement with the notch of the support rail.

According to another aspect, the recess of the support member further defines a clearance area for providing clearance for slideable movement of the support from the first to the second position.

According to another aspect, the bracket is slideably receivable within the bracket receiving portion.

According to another aspect, a width of the bracket receiving portion is equal to about a width of the rail.

According to another aspect, the support rail is horizontally positioned relative to the ground surface.

According to another aspect, the notch of the rail is at an upward facing portion of the wall-facing surface of the rail.

According to another aspect, a shelving panel extends between two of the at least one support members.

According to another aspect, a bracket for use with a wall mounted shelving system is provided. The bracket includes an elongate member having a first flange on a first end thereof and a second flange on a second end thereof. The first flange is configured for being selectively received in a corresponding recess defined in a support member and the second flange is configured for being selectively received in a corresponding notch defined on a wall-facing surface of a support rail mounted on the wall.

According to another aspect, a wall mounted shelving system is provided. The system includes a support rail mountable on a wall, at least one support member for supporting a shelving panel and defining an end portion for abutting the wall and further defining a recess having a rail receiving portion, and a bracket extending between the support rail and the support member. The bracket has a first flange on a first end thereof for being selectively received in a corresponding recess defined in the support member and has a second flange on a second end thereof for being selectively received in a corresponding notch defined on a wall-facing surface of the support rail.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed. In the drawings.

DETAILED DESCRIPTION

The presently disclosed subject matter is described with specificity to meet statutory requirements. However, the description itself is not intended to limit the scope of this patent. Rather, the inventors have contemplated that the claimed subject matter might also be embodied in other ways, to include different steps or elements similar to the ones described in this document, in conjunction with other present or future technologies.

Figure 1:
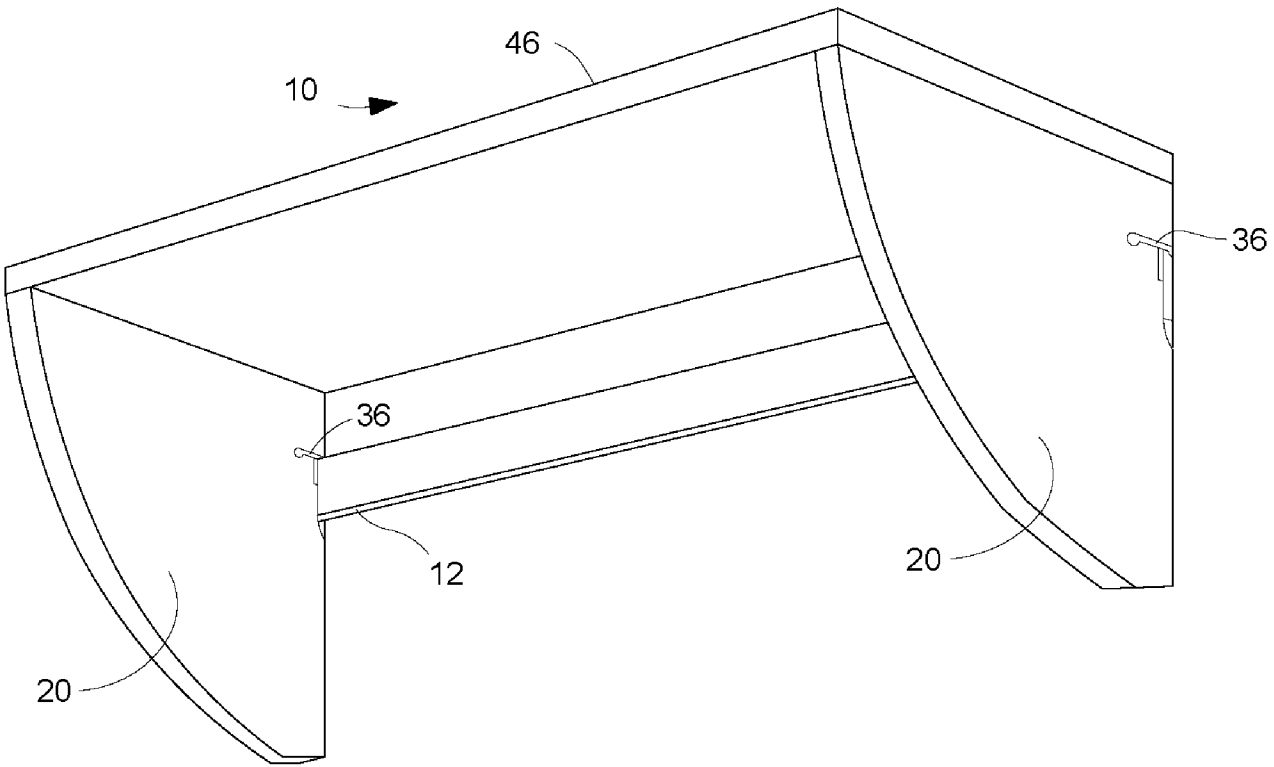
FIG. 1 is a perspective view of a shelving system according to one aspect of the disclosed subject matter.

FIG. 1 illustrates a shelving system for being mounted on a wall or other load bearing surface. The shelving system is generally designated 10 and includes a support rail 12 that is mountable on a wall and a support member 20 that is configured for being attached to the rail 12 by a bracket 36. The rail 12 may be fastened to the wall by any appropriate fastener, including screws drilled into a stud or the use of anchor bolts. A shelving panel 46 may extend between at least two support members 20 and may provide storage for clothing or other goods. The rail 12, support members 20, bracket 36, and panel 46 may be made from metal, wood, plastic, composite, or any other suitable material.

Figure 2A:
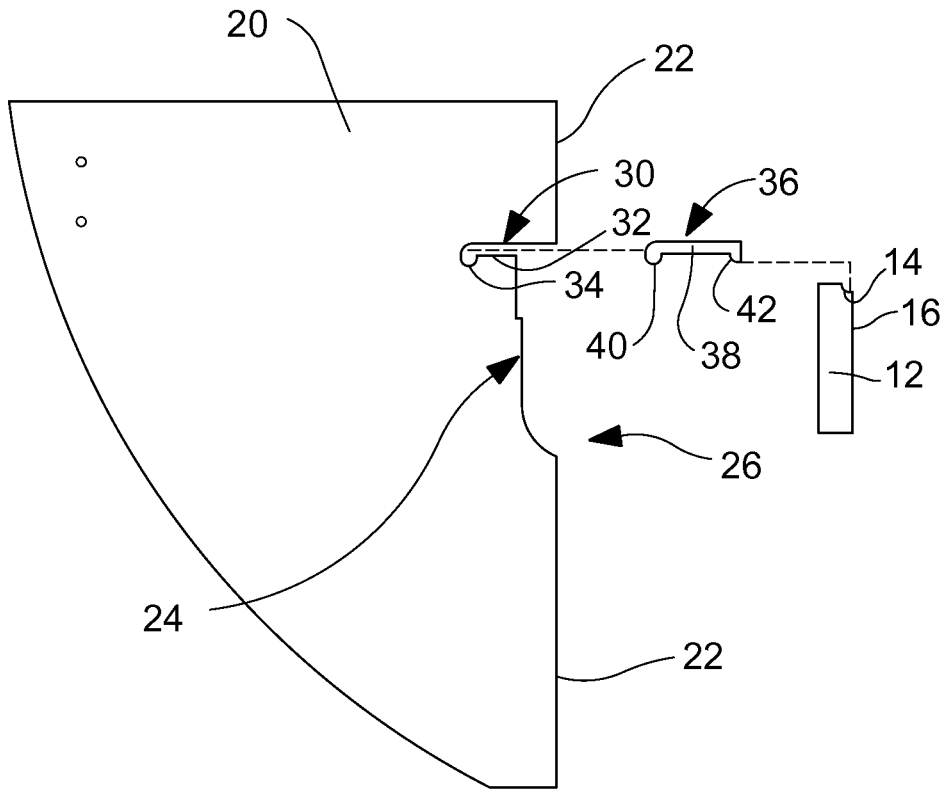
FIG. 2A is an exploded, side view of a shelving system according to one aspect of the disclosed subject matter.
Figure 2B:
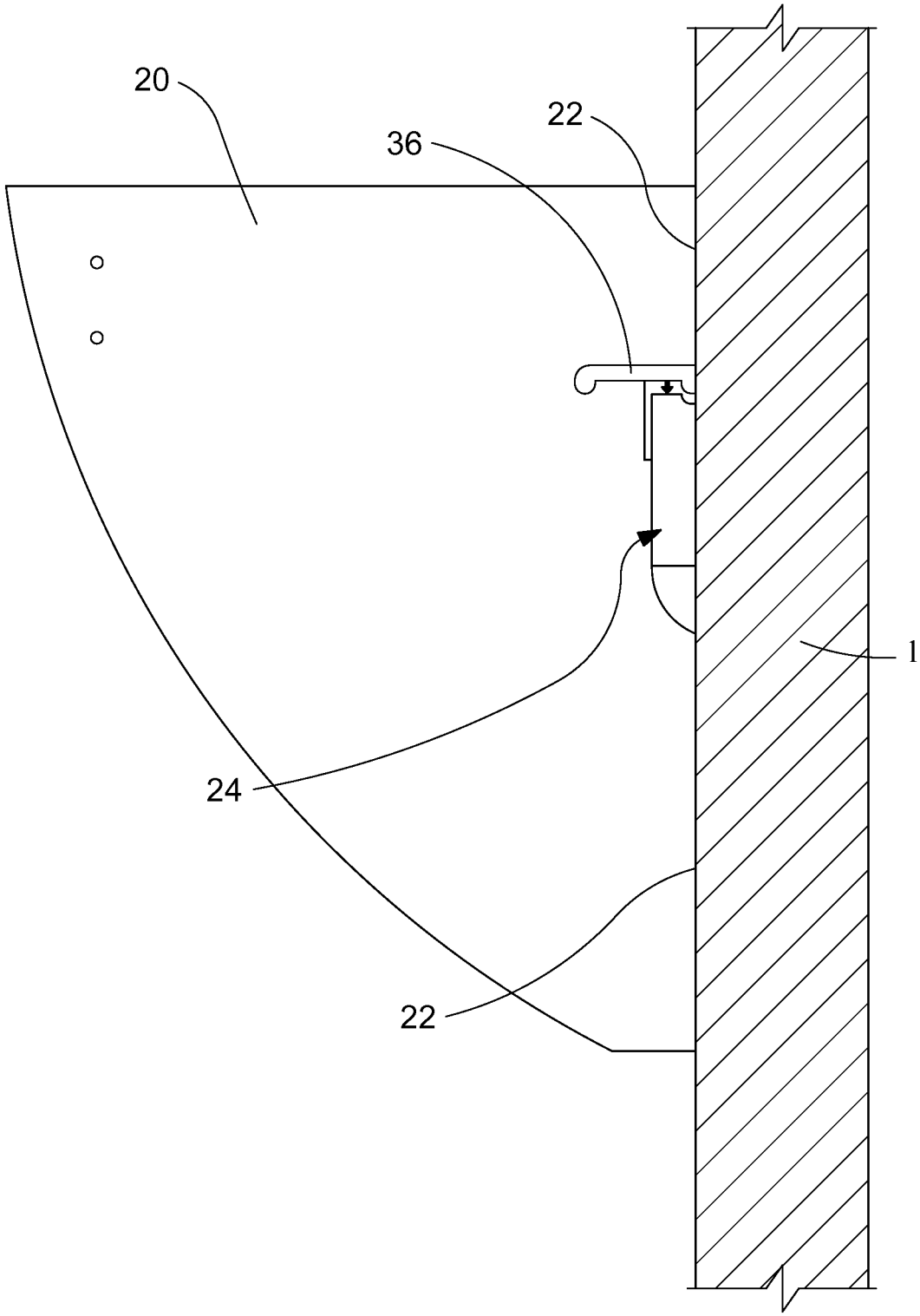
FIG. 2B is a side view of the shelving system of FIG. 2A in a first position according to one aspect of the disclosed subject matter.
Figure 2C:
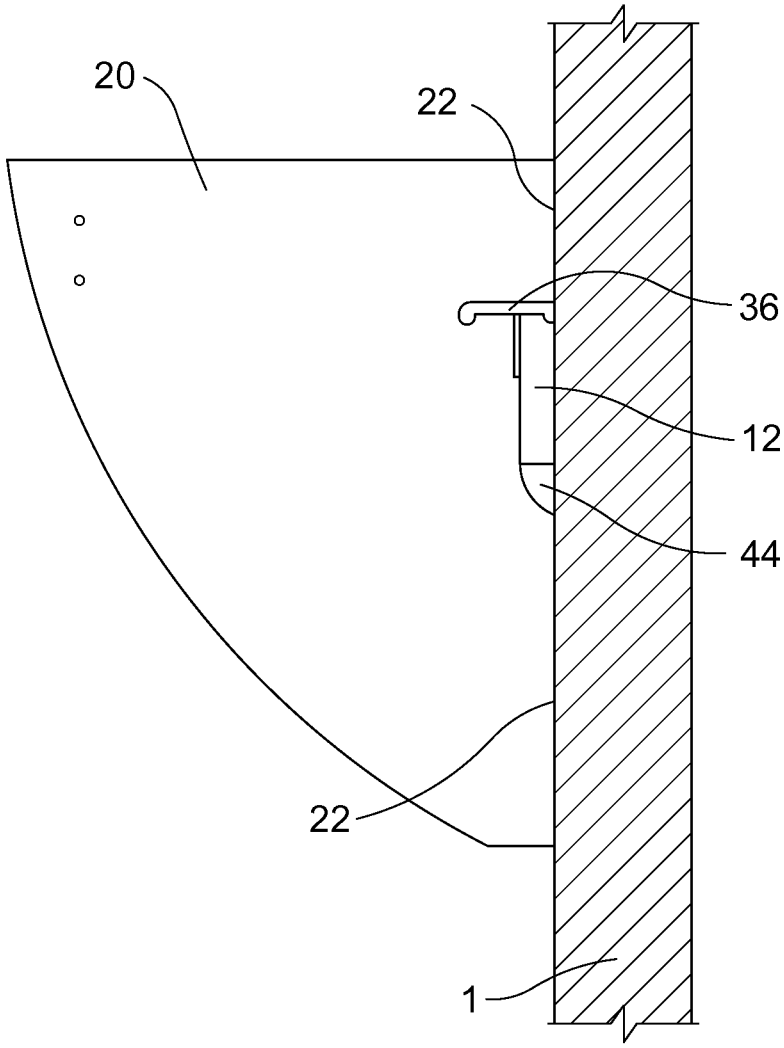
FIG. 2C is a side view of the shelving system of FIG. 2A in a second position according to one aspect of the disclosed subject matter.

FIGS. 2A, 2B, and 2C illustrate a side view of the support member 20 installed on the rail 12. The support member 20 has end portions 22 on upper and lower portions thereof for abutting the wall 1. The support member 20 also defines a recess 24 that has a rail receiving portion 26 and a bracket receiving portion 30. The bracket receiving portion 30 includes a slot 32 with a notch 34 formed on an end thereof for selectively receiving a corresponding elongate portion 38 having a first flange 40 formed on a first end thereof of the bracket 36. The elongate portion 38 interconnects the first flange 40 and a second flange 42 that is configured for being received in a notch 14 defined on a wall-facing surface 16 of the rail 12. In one embodiment, support member 20 may include a bore (not shown) that can receive a screw for fastening the support member 20 to the rail 12. This bore may be angled so that the screw can be provided in any general direction. Additionally, a wedge type element may be provided between the bottom facing side of the rail 12 and a top facing surface at the interface formed at a lowermost portion of recess 44. In this manner, the wedge type element can be positioned in the space defined between the bottom facing side of the rail 12 and the top facing surface at the interface formed at a lowermost portion of recess 44 to further secure the support 20 to the rail 12 such that support 20 cannot be lifted upwards without first removing this wedge type element. In one embodiment, this wedge type element may have a shape to approximate the space defined between the bottom facing side of the rail 12 and the top facing surface at the interface formed at a lowermost portion of recess 44. In another embodiment, recess 44 may have a generally rectangular cross-section as opposed to the elongate arcuate shape illustrated in FIG. 2C, and in this embodiment, the space defined between the bottom facing side of the rail 12 and the top facing surface at the interface formed at a lowermost portion of recess 44 may be spanned with a lead-in screw that is inserted horizontally into the space to thereby further secure the support 20 to the rail 12 such that the support 20 cannot be lifted upwards without first removing the screw.

Figure 3:
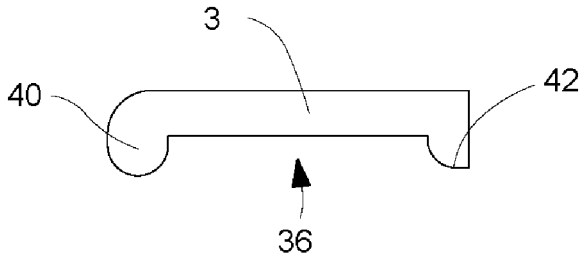
FIG. 3 is a side view of a bracket for use with a shelving system according to one aspect of the disclosed subject matter.
Figure 4:
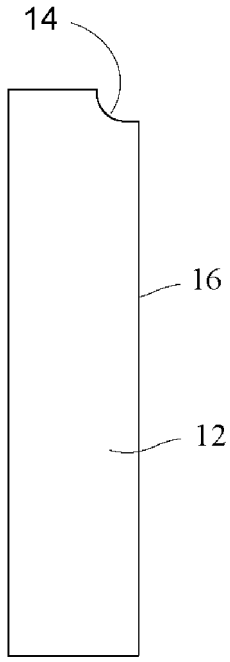
FIG. 4 is a side view of a rail for use with a shelving system according to one aspect of the disclosed subject matter.

FIG. 3 illustrates the bracket 36 having the elongate portion 38, the first flange 40 on the first end, and the second flange 42 on the second end. First flange 40 is illustrated in FIG. 3 as having a generally rounded cross-section, but in other embodiments may be any suitable cross-section. Similarly, second flange 42 is illustrated in FIG. 3 as having a generally curved cross-section on a first surface and a generally straight cross-section on an opposing second surface, but in other embodiments may be any suitable cross-section. The support rail 12 is illustrated in FIG. 4 as being a generally rectangular cross-section having a rounded notch 14 defined on an upper most, wall-facing surface 16 of the rail, but in other embodiments may also be any suitable cross section and the notch 14 may be defined in any suitable location.

As illustrated in FIGS. 2A, 2B, and 2C, the rail 12 has a width that approximates a width of the rail receiving portion 26. In this manner, when the support member 20 is installed on the rail 12, the end portions 22 matingly engage with the wall 1 and the rail 12 fits within the recess 24. Additionally, this relationship is such that the rail 12 tends to cover the machined arcuate portions of the recess 24 so that those portions are not visually exposed. A clearance area 44 is defined between a bottom most portion of the rail 12 and the support member 20 that allows for sliding installation of the support member 12 onto the rail. In this manner, the shelving system 10 is assembled by engaging the bracket 36 within the bracket receiving portion 30 of the support member 20. The support member 20 is then positioned such that the rail 12 is within the rail receiving portion 26 but positioned below the bracket 36 as illustrated in FIG. 2B. The support member is then manipulated towards the rail 12 until the flange 42 of the bracket 36 engages the notch 14 of the rail 12, as illustrated in FIG. 2C. Disassembly is the reverse of assembly. Under typical use, the end portions 22 will rest against the wall 1 and provide increased structural rigidity of the shelving system 10 when compared to systems available in the prior art. In other embodiments, bracket 36 could first be engaged with the notch 14 of the rail 12 and then subsequently engaged with support members 20.

A shelving system 10 according to the disclosed subject matter has been shown to inhibit significantly increased structural load bearing characteristics. Under one testing scenario, it has been shown that each support member 20 can structurally support 250 pounds of weight hanging therefrom.

Figure 5:
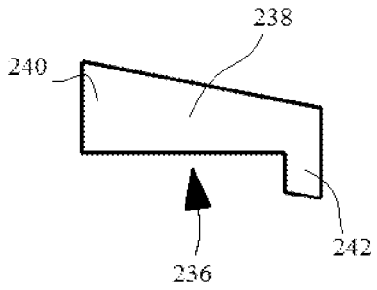
FIG. 5 is a side view of a bracket for use with a shelving system according to one aspect of the disclosed subject matter.
Figure 6:
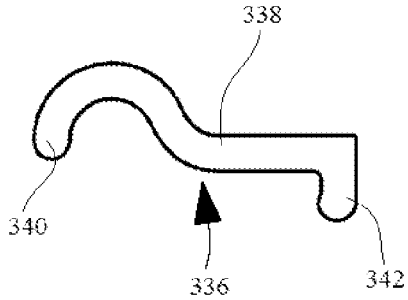
FIG. 6 is a side view of a bracket for use with a shelving system according to one aspect of the disclosed subject matter.
Figure 7:
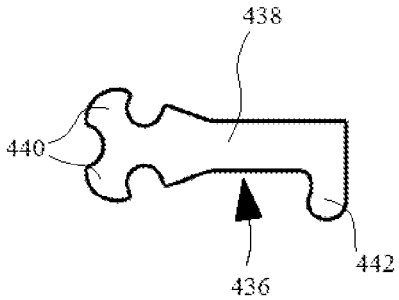
FIG. 7 is a side view of a bracket for use with a shelving system according to one aspect of the disclosed subject matter.

Additional aspects of the disclosed subject matter are illustrated in FIGS. 5, 6, and 7. As illustrated in FIG. 5, a bracket 236 includes an elongate portion 238 with a wide base 240 on a first end thereof that tapers towards a flange 242 on a second end thereof. As illustrated in FIG. 6, a bracket 336 includes an elongate portion 338 that has a curved portion terminating in a flange 340 on a first end thereof and a second flange 342 formed on a second end thereof. As illustrated in FIG. 7, a bracket 436 includes an elongate portion 438 having a plurality of flanges 440 on a first end thereof and a flange 442 on a second end thereof. Each of the plurality of flanges 440 are defined by a cutout portion in the material surrounding each flange 440. Each of brackets 236, 336, and 436 are configured to be received within a correspondingly shaped recess defined in the support member 20 in a similar manner as illustrated in regards to FIGS. 1 through 4.

The shelving system 10 offers additional advantages in the fact that the system is modular and can be easily installed in most homes or commercial areas. Additionally, in any one project, a plurality of shelving systems 10 may be provided if desired. In one or more embodiments, there may be hanging rods, drawers, and other items associated with traditional shelving spaces provided. In this manner, the system 10 is adaptable to a wardrobe support or a panel of substantial length.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A wall mounted shelving system comprising:

a support rail mountable on a wall and having an upward-facing surface, a wall-facing surface, and a concave rounded notch defined between the upward-facing surface and the wall-facing surface;

at least one support member mountable on the rail and defining an end portion for abutting the wall and further defining a recess having a rail receiving portion and a bracket receiving portion, the bracket receiving portion including a slot having an open end for facing the wall, a closed end opposite the open end and a vertically-offset concave rounded notch formed below the closed end; and a one-piece bracket having an elongate member configured to extend from the rail through the slot of the bracket receiving portion of the support member and having a convex rounded first flange on a first end of the elongate member and a convex partially rounded second flange on a second end of the elongate member opposite the first end, the first flange and second flange extending in a common direction from the elongate member, the first flange dimensioned to matingly engage the notch of the bracket receiving portion of the support member, and the second flange dimensioned to matingly engage the notch of the support rail.

2. The system according to claim 1, wherein a support-facing surface of the rail opposite the wall-facing surface thereof engages a wall-facing surface of the rail receiving portion of the support member.

3. The system according to claim 1, wherein the support member is moveable from a first position in which the second flange of the bracket is not in engagement with the notch of the support rail and a second position in which the second flange of the bracket is in engagement with the notch of the support rail.

4. The system according to claim 3, wherein the recess of the support member further defines a clearance area for providing clearance for slideable movement of the support member from the first to the second position.

5. The system according to claim 1, wherein the bracket is slideably receivable within the bracket receiving portion.

6. The system according to claim 1, wherein a width of the bracket receiving portion is equal to about a width of the rail.

7. The system according to claim 1, wherein the support rail is horizontally positioned relative to a ground surface.

8. The system according to claim 1, wherein a shelving panel extends between two of the at least one support members.

9. A wall mounted shelving system comprising:

a support rail mountable on a wall, the support rail having a wall-facing surface and a concave rounded notch defined along a top margin of the wall-facing surface;

at least one support member for supporting a shelving panel and defining an end portion for abutting the wall and further defining a recess having a rail receiving portion and a contiguous slot and an interior concave rounded notch, the notch being spaced-apart from the end portion and defined within an interior of the support member; and a one-piece bracket having an elongate member extending between the support rail and the support member and having a convex rounded first flange on a first end of the elongate member for being selectively received in the concave rounded notch of the support member and having a convex partially rounded second flange on a second end of the elongate member for being selectively received in the concave rounded notch of the support rail, the first flange and second flange extending downwardly from the elongate member and the elongate member being received within the slot of the support member.

* * * * *